US005116651A

United States Patent [19]

Katsura et al.

[11] Patent Number: 5,116,651

[45] Date of Patent: May 26, 1992

[54] EASILY OPENABLE SEALED PACKAGE CONTAINER

[75] Inventors: Tadahiko Katsura; Kikuo Matsuoka; Kazuo Miyake, all of Yokohama; Kazuo Taira, Tokyo; Yoshiki Watanabe, Yokohama; Hiroshi Ueno, Yokosuka, all of Japan

[73] Assignee: Toyo Seikan Kaisha, Ltd., Tokyo, Japan

[21] Appl. No.: 460,064

[22] PCT Filed: May 18, 1989

[86] PCT No.: PCT/JP89/00500

§ 371 Date: Mar. 16, 1990

§ 102(e) Date: Mar. 16, 1990

[87] PCT Pub. No.: WO89/11426

PCT Pub. Date: Nov. 30, 1989

[30] Foreign Application Priority Data

| | | | |
|---|---|---|---|
| May 19, 1988 | [JP] | Japan | 63-120667 |
| Jun. 30, 1988 | [JP] | Japan | 63-161022 |
| Jun. 30, 1988 | [JP] | Japan | 63-161024 |

[51] Int. Cl.[5] ..... B65D 41/00

[52] U.S. Cl. ..... 428/35.7; 220/359; 220/457; 428/35.8; 428/36.92; 428/344; 428/399

[58] Field of Search ..... 428/35.8, 35.9, 36.92, 428/35.7, 344, 339; 220/359, 457

[56] References Cited

U.S. PATENT DOCUMENTS

| | | | |
|---|---|---|---|
| 4,596,861 | 6/1986 | Sheih et al. | 428/35.8 |
| 4,656,068 | 4/1987 | Raines | 428/36.92 |
| 4,722,982 | 2/1988 | Tawaka | 428/35.8 |
| 4,766,018 | 8/1988 | Hinrichsen et al. | 428/35.9 |

*Primary Examiner*—James J. Seidleck
*Attorney, Agent, or Firm*—Sughrue, Mion, Zinn Macpeak & Seas

[57] ABSTRACT

A sealed vessel is formed by heat-sealing a lid to a flanged vessel proper while forming a coating of a composition prepared by dispersing a small amount of an acid-modified olefin resin in a thermosetting resin on one of the faces to be heat-sealed and forming an olefin resin layer on the other face to be heat-sealed. The heat-sealed portion of this vessel has excellent heat resistance and excellent pressure resistance, and opening in the heat-sealed faces can be easily accomplished by hands.

11 Claims, 2 Drawing Sheets

FIG. 1-A
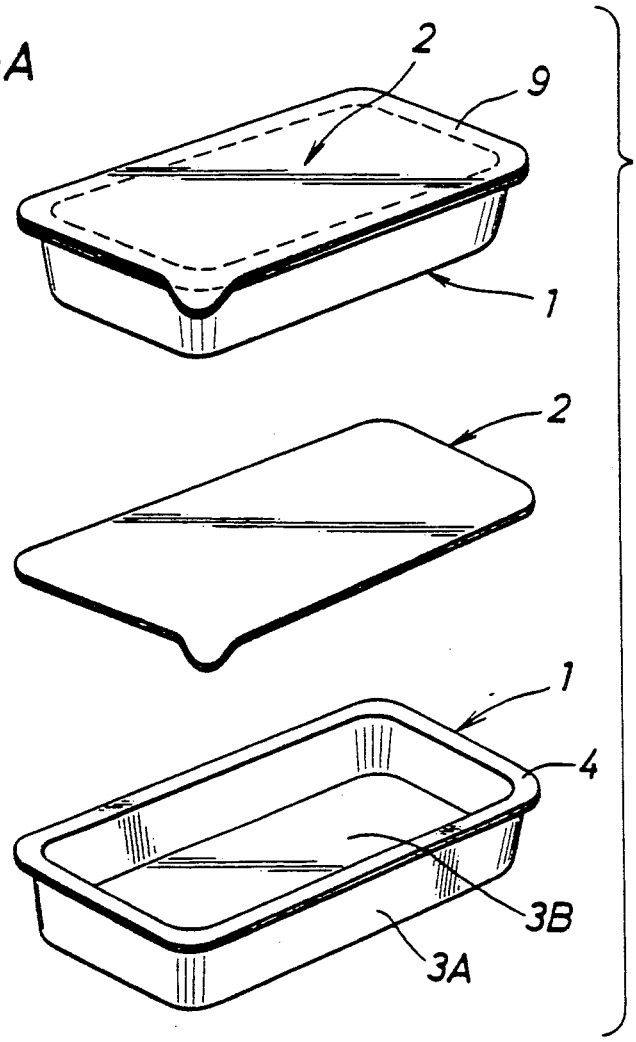
FIG. 1-B
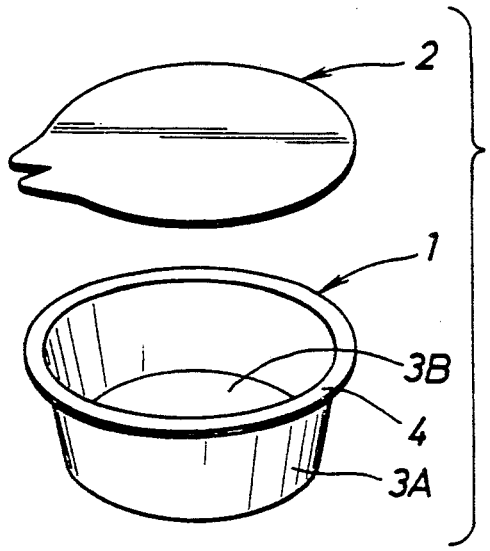

FIG. 2-A
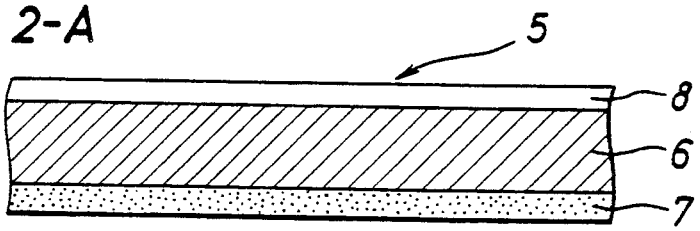
FIG. 2-B
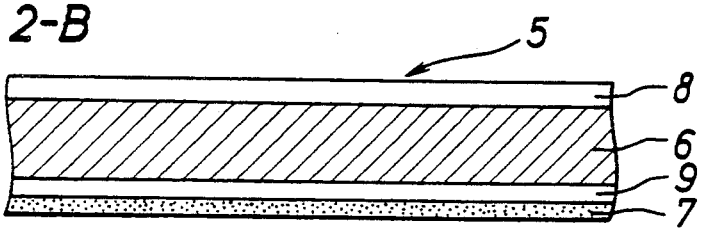
FIG. 3-A
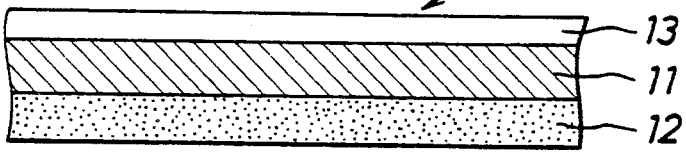
FIG. 3-B
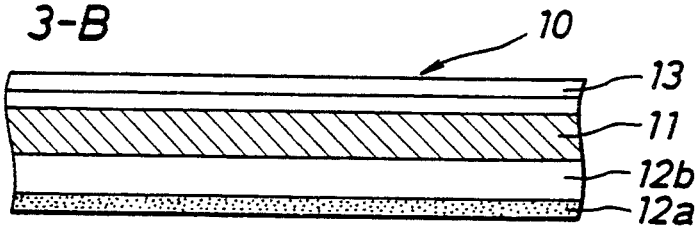

EASILY OPENABLE SEALED PACKAGE CONTAINER

DESCRIPTION

1. Technical Background

The present invention relates to an easy-open sealed packaging vessel. More particularly, the present invention relates to an easy-open sealed packaging vessel having a pressure-resistant performance capable of resisting a sterilization treatment such as retort sterilization and an easy openability in combination.

2. Description of the Prior Art

A vessel comprising a flanged vessel proper obtained by draw-forming of a metal foil sheet and a lid heat sealed to the vessel proper through the flange portion and a vessel comprising a flanged vessel proper having at least an inner surface formed of a resin and a lid formed of a metal foil sheet having an inner face of a resin, which is heat-sealed to the vessel proper through the flange portion, are widely used in the field of packaging of foods.

An inner face-covering layer of a paint or the like is formed on a metal foil sheet for such vessels or lids so as to prevent direct contact between the metal and content and protect the metal, and an inner face material composed of an olefin resin is formed on the inner face of a mating member for the purpose of heat sealing.

As the means for increasing the adhesion between a coating and an olefin resin, a method in which an acid-modified olefin resin is incorporated into the coating and the acid-modified olefin resin is predominantly distributed in the surface portion of the coating to improve the heat adhesiveness between the coating and olefin resin has already been known from Japanese Examined Patent Publication No. 58-2825.

This conventional technique is advantageous in that a strong adhesion can be attained between the coating and the olefin resin layer, but this conventional technique involves a problem in that the heat seal strength is too high for a so-called peelable sealed vessel where the heat sealed interface between the lid and the flange is peeled by hands for opening.

As means for solving this problem, Japanese Examined Patent Publication No. 58-385 proposes a structure of a plurality of coatings in which peeling is effected between the coatings, and Japanese Examined Patent Publication No. 56-22699 proposes a method in which the distribution of the acid-modified olefin resin in the coating is controlled by a distribution-controlling layer disposed below the coating. However, these proposals are defective in that the coating operation should be performed in two stages.

SUMMARY OF THE INVENTION

It is therefore a primary object of the present invention to provide an easy-open sealed packaging vessel which has a sealing performance or pressure-resistant performance capable of resisting a sterilization treatment such as retort sterilization and an easy openability in combination, in which an easy peeling performance is attained between an acid-modified olefin-containing coating and an inner face material composed of an olefin resin.

Another object of the present invention is to provide an easy-open sealed packaging vessel in which the peel strength in the heat-sealed interface can be adjusted easily and assuredly by adjusting the composition of an acid-modified olefin resin coating and/or the composition of an inner face material of an olefin resin.

Still another object of the present invention is to provide an easy-open sealed packaging vessel comprising a flanged vessel proper prepared by draw-forming of a coated metal foil sheet and a lid of a metal foil substrate having an inner face material composed of a polyolefin resin, in which opening in the heat-sealed portion can be easily accomplished.

A further object of the present invention is to provide a retortable packaging vessel, in which at least the inner face side of a vessel proper is composed of a polyolefin, a lid is composed of a metal foil sheet having a coating formed on the inner face side thereof, the heat-sealed portion formed between the vessel proper and the lid has a sealing performance capable of resisting the retort sterilization and enduring the subsequent storage, and at the opening operation, the heat-sealed interface between the vessel proper and the lid can be easily peeled without occurrence of feathering.

A still further object of the present invention is to provide a toastable packaging vessel in which a scorched cooked food does not adhere to the vessel wall even if the vessel is subjected to heating and cooking in an oven toaster, and a good flavor can be retained.

In accordance with the present invention, there is provided an easy-open sealed packaging vessel comprising a flanged vessel proper, a lid and a heat-sealed portion formed between the flange of the vessel proper and the lid, wherein one of the flanged vessel proper and the lid has a covered structure comprising a metal foil sheet and a coating of a composition formed by dispersing in a thermosetting resin an acid-modified olefin resin in such a small amount as giving an easily peelable bonding, said coating being applied to the inner face side of the metal·foil sheet, the other of the flanged vessel proper and the lid has a structure having a polyolefin resin at least on the inner face side thereof, and an easily peelable sealing is attained between the lid and the flange of the vessel proper.

In the present invention, it is preferred that the coating be a coating of an epoxy-curing agent resin containing 0.8 to 30% by weight, based on the coating, of the acid-modified olefin resin and the polyolefin resin constituting at least the inner face side be an olefin copolymer or olefin resin blend having 50 to 95% by weight of units of the same olefin as the olefin constituting the acid-modified resin. It is especially preferred that the covering degree (l), defined by the following formula, of the coating be in the range of from 0.3 to 20:

$$l = \frac{L}{1 + \frac{100}{X} \cdot \frac{d_2}{d_1}} \quad (1)$$

wherein L represents the thickness (μm) of the coating, X represent the amount incorporated of the acid-modified polyolefin in parts by weight per 100 parts by weight of the thermosetting resin, $d_1$ represents the density (g/cm$^3$) of the thermosetting resin and $d_2$ represents the density (g/cm$^3$) of the acid-modified polyolefin.

In accordance with one preferred embodiment of the present invention, there is provided an easy-open sealed packaging vessel comprising a flanged vessel proper prepared by draw-forming a metal foil sheet and a lid heat-sealed to the flange of the vessel proper, wherein the vessel proper comprises as an inner face covering layer a coating composed of an epoxy-curing agent resin containing 0.8 to 30% by weight, based on the coating, of an acid-modified olefin resin, and the lid comprises as an inner face material a layer of an olefin copolymer or olefin resin blend containing 50 to 95% by weight of units of the same olefin as the olefin constituting the acid-modified olefin resin.

In accordance with another preferred embodiment of the present invention, there is provided an easy-open sealed packaging vessel comprising a flanged vessel proper and a lid heat-sealed to the flange of the vessel proper, wherein the flanged vessel proper having at least the inner face side formed of a polyolefin resin, and the lid is composed of a metal foil having on the inner face side an inner face-protecting coating composed of a paint containing an acid-modified polyolefin in such a small amount as giving an easy peelability to the sealed interface.

In accordance with still another preferred embodiment of the present invention, there is provided a toastable sealed packaging vessel comprising a flanged vessel proper prepared by draw-forming of a metal foil sheet and a lid heat-sealed to the flange of the vessel proper, wherein the vessel proper has on the entire inner face including the flange an inner face-protecting coating composed of a paint formed by dispersing an acid-modified polyolefin in a thermosetting resin paint having a heat softening temperature of 90° to 130° C.

BRIEF DESCRIPTION OF THE DRAWINGS

FIG. 1-A is a perspective view illustrating an embodiment of the tray-shaped sealed packaging vessel of the present invention in the assembled state and separated state.

FIG. 1-B is a perspective view illustrating an embodiment of the cup-shaped packaging vessel of the present invention in the separated state.

FIG. 2-A is a sectional view illustrating an example of the sectional structure of a vessel proper sheet used in the present invention.

FIG. 2-B is a sectional view illustrating another example of the sectional structure of a vessel proper sheet used in the present invention.

FIG. 3-A is a sectional view showing an example of the sectional structure of a lid sheet used in the present invention.

FIG. 3-B is a sectional view showing another example of the sectional structure of a lid sheet used in the present invention.

DETAILED DESCRIPTION OF THE PREFERRED EMBODIMENTS

Packaging Vessel

Referring to FIGS. 1-A and 1-B illustrating examples of the vessel of the present invention, the packaging vessel comprises a vessel proper 1 and lid 2, and the vessel proper 1 is prepared by draw-forming of a sheet, described hereinafter, and comprises a tapered or cylindrical barrel wall portion 3A, a bottom portion 3B connected to the lower end of the barrel wall portion and a flange portion 4 connected to the upper end of the barrel wall portion.

In the present invention, one of the vessel proper 1 and the lid 2 is composed of a covered structure having a metal foil sheet and an acid-modified olefin resin-containing coating formed on the inner face side of the metal foil sheet, and the other of the vessel proper 1 and the lid 2 is composed of a structure having a polyolefin resin at least on the inner face side.

Referring to FIGS. 2-A and 2-B showing the sectional structure of the vessel proper sheet, this sheet 5 comprises a metal foil 6, an inner face covering layer 7 formed on the surface, to be formed into an inner face of the vessel, of the metal foil, and an outer face covering protecting layer 8, formed on the surface to be formed into the outer face of the vessel, of the metal foil.

As shown in FIG. 2-B, an intervening layer 9 such as adhesive layer, an adhesive primer layer, another resin film layer or an undercoat layer can be formed between the metal foil 6 and the inner face covering layer 7.

The lid 2 is composed of a laminate described hereinafter, and has the same dimension and shape as those of the periphery of the flange portion of the vessel proper and a heat-sealed portion 9 is formed between the lid 2 and the flange portion 4. Referring to FIGS. 3-A and 3-B showing the sectional structure of the laminate constituting the lid 2, this laminate 10 comprises a substrate layer 11 formed of a metal foil or the like, an inner face material layer 12 formed on the surface, to be formed into the innermost face of the vessel, of the substrate 11, and an outer face-protecting layer 13 formed on the outer surface of the substrate layer 11. The inner face material layer 12 may comprise a substrate layer **12*b* and a surface layer 12*a* (see FIG. 3**-B).

The inner face covering layer 7 of the vessel and the inner face material layer 12 (**12*a***) of the lid are combined so that one of them is an acid-modified olefin resin-containing coating and the other is composed of a polyolefin resin.

A thermosetting resin paint, especially a paint formed by dispersing in an epoxy-curing agent resin paint an acid-modified olefin resin in such a small amount as giving a peelable bonding, is used for the acid-modified olefin resin-containing coating. Preferably, the modified olefin resin is incorporated in an amount of 0.8 to 30% by weight, especially 1.5 to 20% by weight, based on the coating.

If heat sealing is effected between this coating and the polyolefin resin, a heat-sealed bonding which can resist the retort sterilization while retaining an easy openability by hands is formed.

This coating exerts both of the function of forming a heat-sealed face and the function of protecting the metal foil. The coating of the thermosetting resin, especially the epoxy-curing agent resin, is indispensable because the coating is one of coatings excellent in the adhesion to the metal foil and the barrier property to corrosive components and also in the affinity with the acid-modified olefin resin. In order to produce a heat sealability between the coating and the olefin resin inner face material, it is important that the acid-modified olefin resin should be contained in the coating. Namely, if only the olefin resin is incorporated in the coating, no bonding is formed between the olefin resin and the epoxy-phenolic resin constituting the coating. Accordingly, it will be understood that it is important that the olefin resin to be contained in the coating should be acid-modified in advance.

In the present invention, it also is important that the acid-modified olefin resin should be incorporated in the above-mentioned amount. If the amount incorporated of the modified olefin resin is too small and below the above-mentioned range, the heat seal strength to the olefin resin inner face material is often so low as incapable of resisting the retort sterilization. If the amount incorporated of the modified olefin resin is too large and exceeds the above-mentioned range, the adhesive force of the coating to the metal foil and the corrosion resistance of the coating are reduced. Furthermore, the extraction resistance expressed by potassium permanganate consumption or the like is degraded and the flavor-retaining property to the content tends to decrease.

It should be understood that the acid-modified olefin resin is incorporated in the coating in such a small amount as imparting an easy peelability to the heat-sealed interface between the coating and the polyolefin. By the easy peelability referred to herein, it is meant that a sufficient sealing performance is maintained at the retort treatment and during the subsequent storage, and peeling is easily accomplished in the interface by hands at the time of opening.

More specifically, if the amount incorporated of the acid-modified olefin is selected so that the covering degree (l) represented by the formula (1) is in the range of from 0.3 to 20, especially from 0.4 to 10, with reference to the thickness L of the inner face-protecting coating, the amount incorporated X of the acid-modified polyolefin, the density $d_1$ of the paint resin and the density $d_2$ of the acid-modified polyolefin, satisfactory characteristics can be obtained. If the covering degree (l) is too low and below the above-mentioned range, the peel strength or sealing reliability is lower than when the covering degree (l) is within the above-mentioned range, and if the covering degree (l) exceeds the above-mentioned range, the easy-openable seeling performance is degraded.

In the present invention, whether the acid-modified olefin resin-containing coating is formed on the vessel proper or the lid depends on the intended use of the packaging vessel or the required characteristics.

For example, by forming an inner face-protecting coating on the vessel proper by using a paint formed by incorporating and dispersing the acid-modified polyolefin into the thermosetting resin paint, even if heating cooking is carried out in an oven toaster, a prominent advantage is attained in that a scorched cooked food does not adhere to the vessel wall.

The reason why this advantage is attained according to the present invention has not been completely elucidated, but it is presumed that since the acid-modified polyolefin has a density lower than that of the thermosetting resin, if a protecting coating containing the acid-modified polyolefin is formed, the acid-modified polyolefin is held in the rising state on the surface of the coating, and by the lubricating effect of the rising acid-modified polyolefin, the scorched cooked food is prevented from adhering to the surface of the vessel wall.

In the present invention, since the acid-modified polyolefin is incorporated into the paint, by forming this inner face-protecting coating on the entire inner face of the vessel including the flange of the vessel, heat sealing can be accomplished between the vessel proper and the lid even without forming a particular heat-sealable resin layer.

Moreover, by the surface active action of the acid-modified polyolefin per se, the wetting property of the paint is improved, and when the paint is applied to the inner face of the vessel, a uniform protecting coating can be formed while effectively controlling the formation of pinholes. By dint of the presence of this protecting coating, the lubricating property is improved, and when the vessel proper is prepared by draw-forming, galling and abrasion can be effectively controlled.

In this embodiment of the present invention, a thermosetting resin paint having a heat softening temperature of 90° to 130° C. is preferably used as the paint into which the acid-modified polyolefin is dispersed.

Since an oven toaster is not provided with a temperature-adjusting mechanism, if heating cooking is carried out in the oven toaster, it often happens that the vessel is heated at a very high temperature. For example, if the content food is gratin, the temperature of the flange portion of the vessel is elevated to about 220° C. in the state where the gratin is cooked. Accordingly, if a thermosetting resin paint having a heat softening temperature lower than 90° C. is used, softening of the coating or formation of thermal decomposition products is caused at the heating cooking, and the flavor of the content food is drastically degraded. If the heat softening temperature is higher than 130° C., the protecting coating becomes too rigid and draw-forming is difficult. As shown in the examples given hereinafter, this heat softening temperature can be measured by the penetration temperature-elevating method using a thermal mechanical analysis apparatus (TMA).

An advantage of prevention of occurrence of the feathering phenomenon is attained if the acid-modified olefin resin-containing coating is formed on the lid.

In case of a vessel comprising a flanged vessel proper and a lid heat-sealed to the flange of the vessel proper, the most serious problem caused when opening is effected by peeling in the heat-sealed interface is occurrence of a so-called feathering phenomenon. Namely, clear peeling is not caused in the heat-sealed portion and the cohesive failure is caused in the heat-sealable resin and fragments of the heat-sealable resin are formed, with the result that the appearance characteristics of the opening portion are degraded. In this embodiment of the present invention, if the coating is formed on the inner face side of the lid and the polyolefin layer is formed on the vessel proper, since the polyolefin is present only in the flange portion on the plane including the heat-sealed face and the coating having an excellent adhesion to the metal foil and a much larger cohesive force than that of the polyolefin is present on the lid located on the substantially same plane as the flange portion, occurrence of the above-mentioned feathering phenomenon can be effectively prevented.

If the coating is formed on the lid and the polyolefin layer is formed on the vessel proper, an advantage is also attained with respect to the corrosion resistance. In the case where both of the lid and the metal proper are provided with a metal substrate, the vessel proper is prepared by draw-forming the metal blank into a cup shape and the lid is prepared by shearing a metal blank into a predetermined shape. Accordingly, in order to prevent damage at the processing to the vessel proper which is subjected to severe processing, it is preferred that the vessel proper be covered with a rein film having a much larger thickness than that of the coating. On the other hand, the degree of processing of the lid is low and the lid is hardly damaged by processing. Accordingly, it is sufficient if the coating excellent in the barrier property to corrosive components over the resin film is formed in a small thickness on the lid.

In the present invention, an optional resin selected from known polyolefin resins described hereinafter can be used as the polyolefin resin in combination with the acid-modified olefin resin-containing coating. In order to attain a good sealing performance or pressure-resistant performance capable of resisting the retort treatment and a good easy openability in combination, an olefin copolymer or olefin resin blend comprising 50 to 95% by weight, especially 65 to 85% by weight, of units of the same olefin as the olefin constituting the acid-modified olefin resin is preferably used as the polyolefin resin. If the content of units of the same olefin as the olefin constituting the acid-modified olefin resin in the olefin copolymer or olefin resin blend is too low and below the above-mentioned range, a sealing performance or pressure-resistant performance capable of resisting the retorting treatment cannot be attained, and if the content is too high and exceeds the above-mentioned range, the heat seal strength is too high and opening by hands becomes difficult.

According to this embodiment of the present invention, as the olefin resin inner face material to be heat-sealed to the acid-modified olefin resin-containing epoxy-phenolic coating, a inner face material layer composed of an olefin copolymer or olefin resin blend comprising a predetermined amount of units of the same olefin as that of the acid-modified olefin resin is used, whereby a heat-sealed portion having a good resistance to the retort treatment and a good easy openability can be formed.

Acid-Modified Olefin Resin-Containing Paint

A resin formed by graft-modifying an olefin resin with an ethylenically unsaturated carboxylic acid or an anhydride thereof is used as the acid-modified olefin resin. As the trunk polymer of the olefin resin, there can be mentioned low-density polyethylene, medium-density polyethylene, high-density polyethylene, linear low-density polyethylene, homopolypropylene, a crystalline propylene/ethylene copolymer, polybutene-1, polypentene-1, a butene-1/propylene copolymer and a butene-1/propylene/ethylene terpolymer. From the viewpoint of the resistance to the retort treatment, homopolypropylene is preferably used. As the ethylenically unsaturated carboxylic acid or anhydride thereof, there can be mentioned acrylic acid, methacrylic acid, maleic acid, fumaric acid, crotonic acid, itaconic acid, citraconic acid, 5-norbornene-2,3-dicarboxylic acid, maleic anhydride, citraconic anhydride, 5-norbornene-2,3-dicarboxylic anhydride and tetrahydrophthalic anhydride. From the viewpoint of the heat sealability, maleic anhydride is especially preferably used. It is preferred that the acid group content in the used acid-modified olefin resin be 0.01 to 600 meq/100 g of the resin, especially 1.0 to 200 meq/100 g of the resin, as the carbonyl group (=CO).

An optional metal paint selected from known paints having a good adhesion to a metal foil can be used as the paint into which the acid-modified polyolefin is dispersed, but in general, a thermosetting paint, especially a thermosetting paint having a glass transition point (tg) of 90° to 130° C., particularly 95° to 120 ° C., as determined by the thermal mechanical analysis method (TMA), is advantageously used. Amount such paints, a paint comprising an epoxy resin and a curing agent resin for the epoxy resin is especially preferably used in view of the adhesion to the metal foil and the barrier property to corrosive components. As the epoxy resin, a bisphenol type epoxy resin obtained by polycondensation between a biphenol such as bisphenol A and an epihalohydrin is preferably used, and it is preferred that the epoxy equivalent of the bisphenol type epoxy resin be in the range of from 400 to 20,000, especially from 1,000 to 5,000. As the curing agent resin having a reactivity with the epoxy resin, there can be used resins having a functional group having a reactivity with the hydroxyl group or oxirane ring, such as a hydroxyl group, an amino group or a carboxyl group, for example, a resol type and/or novolak type phenolformaldehyde resin, a urea-formaldehyde resin, a melamine (benzoguanamine)-formaldehyde resin, an alkyd resin, a polyester resin, an acrylic resin, a polyurethane resin, a xylene resin, an epoxy ester resin and a butyral resin. These resins can be used singly or in the form of a mixture of two or more of them. Among these resins, a resol type phenolic resin and an amino resin are preferably used.

It is preferred that the epoxy resin/curing agent resin weight ratio be in the range of from 95/5 to 40/60, especially from 90/10 to 50/50.

The coating is formed by dispersing the acid-modified olefin resin in a solution of the above-mentioned paint and coating and baking the paint on the metal foil. It is preferred that the thickness of the coating be 2 to 30 μm, especially 5 to 20 μm. Baking of the coating is carried out at 180°to 250° C. for 30 seconds to 10 minutes.

Polyolefin Resin

Polyolefins exemplified above as the trunk polymer of the acid-modified polyolefin, that is, low-density polyethylene, medium-density polyethylene, high-density polyethylene, linear low-density polyethylene, homopolypropylene, a crystalline propylene/ethylene copolymer, polybutene-1, polypentene-1, a butene-1/propylene copolymer and a butene-1/propylene/ethylene terpolymer, can be used as the resin constituting at least the inner face of the vessel proper or the lid. From the viewpoint of the resistance to the retort treatment, homopolypropylene and a propylene copolymer are preferably used. Of course, as the polyolefin inner face material, these resins can be singly used, or blends or copolymers comprising two or more of these resins can be used.

It is preferred that the inner face material used in the present invention should contain units of the same olefin as that of the acid-modified olefin resin in an amount of 50 to 95% by weight, especially 65 to 85% by weight. In other words, the inner face material used in this embodiment of the present invention comprises 5 to 50% by weight of units of an olefin other than the olefin contained in the acid-modified olefin polymer in the form of a copolymer or polymer blend.

For example, in the case where the acid-modified olefin resin is maleic anhydride-modified polypropylene, the inner face material comprises 50 to 95% by weight of propylene units and 5 to 50% by weight of units of an olefin other than propylene, for example, ethylene or butene-1, in the form of a copolymer or blend. This also holds good with respect to the case where the acid-modified olefin resin is acid-modified polyethylene.

As pointed out hereinbefore, from the viewpoint of the resistance to the retort treatment, it is preferred that the inner face material should comprise homopolypropylene or a propylene/ethylene copolymer composed mainly of propylene units. It also is preferred that units of an olefin different from the olefin of the acid-modified olefin resin be contained in the form of a polymer blend in the inner face material. Accordingly, it is recommended that a blend comprising homopolypropylene or a propylene/ethylene copolymer and polyethylene at a weight ratio of from 50/50 to 95/5, especially from 60/40 to 80/20, be used as the inner face material.

Vessel Proper

The vessel proper can be a vessel formed of a metal foil sheet coated with an acid-modified olefin resin-containing paint or a metal foil laminate prepared by laminating an olefin resin on a metal foil, or an olefin resin-containing plastic vessel, so far as the above-mentioned conditions are satisfied.

As the metal foil constituting the vessel proper, there can be mentioned a foil of a light metal such as aluminum, a steel or iron foil, and a surface-treated steel foil such as a tinplate foil, a chromated steel foil, an electrolytically chromated steel foil, a nickel-plated steel foil or a nickel- and tin-plated steel foil. It is preferred that the thickness of the metal foil be 0.2 to 0.05 mm, especially 0.3 to 0.02 mm.

The protecting coating formed on the outer face of the metal foil can be a coating of at least one thermosetting resin selected from the group consisting of a phenol-formaldehyde resin, a urea-foraldehyde resin, a melamine-formaldehyde resin, a xylene-formaldehyde resin, an epoxy resin, an alkyd resin, a polyester resin, a thermosetting acrylic resin and a urethane resin, or a coating of a vinyl resin such as an acrylic resin, a vinyl chloride/vinyl acetate copolymer, a vinyl chloride/vinyl acetate/maleic anhydride copolymer or a vinyl butyral resin, or a thermoplastic resin such as a styrene/butadiene/acrylic acid ester copolymer or a polyamide resin.

A laminate formed by laminating a polyolefin film on a metal foil as mentioned above is used as the metal foil laminate for the vessel. The polyolefin film can be bonded through a polyurethane adhesive, an epoxy adhesive or an acid-modified polyolefin resin. It is preferred that the thickness of the polyolefin film be 10 to 200 μm, especially 30 to 100 μm.

The vessel proper is obtained by subjecting the above-mentioned coated metal foil sheet to a known draw-forming processing and, if necessary, curling the periphery of the flange portion. The draw-forming processing can be carried out by using an optional male mold and a die (female mold). It is preferred that the draw-forming processing be carried out by using a tool disclosed in Japanese Examined Patent Publication No. 56-50645 according to the process disclosed in Japanese Patent Examined Publication No. 57-4408, because the formation of wrinkled in the vicinity of the base of the flange of the barrel portion can be prevented.

Furthermore, the vessel proper can be a plastic cup-shaped vessel formed by subjecting a sheet composed solely of a polyolefin as mentioned above or a laminate sheet comprising inner and outer layers of a polyolefin as mentioned above and an intermediate layer of an oxygen-barrier layer such as an ethylene/vinyl alcohol copolymer, an aliphatic or aromatic polyamide or a vinylidene chloride to vacuum forming, air-pressure forming or plug assist forming at a resin-melting temperature, or a monoaxially or biaxially drawn plastic cup-shaped vessel obtained by similarly forming a sheet as mentioned above at a drawing temperature (solid phase temperature).

Lid

As the substrate of the lid, there can be used a metal foil as mentioned above, a thermoplastic resin film such as a biaxially drawn polyethylene terephthalate film, a biaxially drawn nylon film or a polycarbonate film, a paper and a laminate of two or more of the foregoing substrates, and a lid is formed by applying a polyolefin inner face material or an acid-modified olefin resin-containing paint to the substrate.

In the case where an inner face material layer is formed, it is preferred that the thickness of the inner face material layer be 3 to 100 μm, especially 5 to 40 μm. If a polymer blend layer is used as the inner face material, in order to prevent feathering at the opening operation, it is preferred that the thickness of the polymer blend layer be reduced as much as possible within an allowable range where heat sealing can be performed. For this purpose, according to a preferred embodiment of the present invention, a laminate structure comprising a surface layer of the above-mentioned polymer blend and a supporting layer of a polyolefin comprising constituent units of the same olefin as the main olefin of the polymer blend is adopted for the inner face material. By adopting this laminate structure, the thickness of the polymer blend layer can be reduced to 3 to 10 μm and the thickness of the homopolyolefin supporting layer can be reduced to 20 to 50 μm while performing heat sealing assuredly, and therefore, occurrence of the feathering phenomenon can be prevented. This laminate inner face material can be easily prepared according to the known co-extrusion method. Incidentally, bonding of the substrate and the inner face material can be easily accomplished by using the above-mentioned acid-modified olefin resin or a urethane adhesive.

Various paints and resin films as mentioned above with respect to the vessel proper can be used as the outer face-protecting coating of the lid.

Uses

The packaging vessel of the present invention can be widely used for vessels for which a sterilizing operation such as a retort sterilization treatment is necessary so as to increase the preservability of the content. More specifically, a package capable of enduring the storage can be formed by filling a content into the vessel proper, substituting the inner atmosphere by nitrogen, water vapor or the like if necessary, applying the lid to the flange portion of the vessel proper, heat-sealing the lid to the flange portion at a temperature of 170°to 250° C. by using heat-sealing means such as a heat-sealing bar, a high-frequency induction-heating member or an ultrasonic wave-irradiating member to effect sealing, and sterilizing the sealed vessel at a temperature of 100° to 135° C. for 10 to 60 minutes. After the opening operation, the content can be heated by an electronic range or oven toaster and then eaten.

EXAMPLES

The present invention will now be described in detail with reference to the following examples.

EXAMPLE 1

A brown-colored epoxy-phenolic paint was coated in an amount of 65 mg/dm$^2$ on one surface of a rolled steel foil having a chromate surface-treated layer on the surface and a thickness of 75 μm.

An epoxy-phenolic paint comprising a bisphenol A type epoxy resin and a resol type phenol formaldehyde resin composed of a binuclear component at a weight ratio of 95/5 was coated and dried as the base coat on the other surface of the steel foil. The amount coated of the base coat was 120 mg/dm$^2$. A paint formed by dispersing 6 parts by weight (5.66% by weight) of a powder (having a specific gravity $d_2$ of 0.90 g/cm$^3$) obtained by adding aluminum hydroxide to modified PP having an average carbonyl group concentration of 150 meq/100 g of the polymer, which was prepared by grafting maleic anhydride to isotactic homopolypropylene, into 100 parts by weight of an epoxy-benzoguanamine paint (having a specific gravity $d_1$ of 1.20 g/cm$^3$), was coated as the topcoat on the surface of the base coat and baked at 250° C. for 40 seconds. The amount coated of the topcoat layer was 70 mg/dm$^2$.

When the heat softening temperature of the obtained inner face coating film was measured by the penetration method using a thermal mechanical analysis apparatus (TMA), it was found that the heat softening temperature was 110° C.

When the covering degree l of the topcoat layer of the obtained inner face coating film was calculated according to the formula of $l=L/(1+100\cdot d_2/\times\cdot d_1)$, it was found that the covering degree l was 4.3 (L=58 μm, $d_1=1.20$ g/cm$^3$, $d_2=0.90$ g/cm$^3$).

The obtained material was punched into a blank having a diameter of 135 mm and a square vessel having a height of 25 mm, an outer size of 83 mm, an inner size of 70 mm and a corner R of 25 mm and having a flange portion curled outward was formed by the draw-forming method using a punch of an elastomer.

A lid was prepared in the following manner. Sandwich lamination was carried out by co-extruding an ethylene/propylene copolymer layer having a thickness of 10 μm and a maleic anhydride-modified polypropylene resin layer having a thickness of 15 μm (modified PP was located on the side of an aluminum foil) between a laminate substrate comprising PET having a thickness of 12 μm, biaxially drawn nylon having a thickness of 15 μm and an aluminum foil having a thickness of 20 μm and a co-extruded film comprising a support layer of an ethylene/propylene copolymer having a thickness of 5 μm and a blend layer having a thickness of 5 μm, which comprised 70% by weight of polypropylene and 30% by weight of low-density polyethylene, and a heat treatment by an oven was then carried out to obtain a laminate comprising the PP/LDPE blend layer as the sealing layer. The laminate was punched into a lid having a size of 85 mm×85 mm and having an opening tab at the corner portion.

Macaroni gratin was filled in the so-formed square vessel and the lid was heat-sealed. The sealed vessel was subjected to a retort sterilization treatment at 120° C. for 30 minutes. After the retort sterilization treatment, the heat seal strength between the vessel proper and the lid was measured. It was found that the heat seal strength was 2.5 kg/15 mm. When the lid was opened from the opening tab, peeling was easily accomplished.

The lid was thus removed, and the vessel proper filled with macaroni gratin was heated in an oven toaster of 890 W for 7 minutes, whereby the macaroni gratin was appropriately scorched. When the macaroni gratin was sampled, it was found that the gratin was heated to the interior and tasted very good. A change such as discoloration was not observed in the flange portion of the vessel proper where the temperature was elevated to a highest level by the heating in the oven toaster. When scorch sticking of the macaroni gratin to the inner face of the vessel proper was examined, sticking was not observed at all.

When the macaroni gratin was heated in the oven toaster, no bad smell was generated, and the heated macaroni gratin had no offensive taste or smell.

EXAMPLES 2 to 7 AND COMPARATIVE EXAMPLES 1 to 3

Macaroni gratin-filled samples were prepared in the same manner as described in Example 1 except that the kind of the thermosetting resin of the modified polypropylene-added thermosetting paint used for the topcoat of the inner face of the vessel proper was changed as shown in Table 1, and generation of a bad smell at the heating in the oven toaster and the presence of an offensive smell or taste in the heated macaroni gratin were checked. The amount coated of the topcoat layer was 105 mg/dm$^2$.

The consumption of $KMnO_4$ of the inner face material of the vessel proper having a close relation to the flavor characteristics of the content was measured (according to the method of Notification No. 20 of the Welfare Ministry).

The obtained results are shown in Table 1.

In case of resins in which the heat softening temperature corresponding to the glass transition point was high, no offensive smell was generated at the heating in the oven toaster, and migration of an offensive smell or taste to the heated macaroni gratin was not observed at all. The consumption of $KMnO_4$ was at a low level.

On the other hand, in case of an epoxy-acrylic resin having a high acrylic content and a low heat softening temperature, as in Comparative Example 1, an offensive smell was generated at the heating in the oven toaster. Furthermore, the polyester and vinyl chloride resins used in Comparative Examples 2 and 3 had a low heat softening temperature, and in case of these resins, generation of an offensive taste was observed.

EXAMPLES 8 TO 10 AND COMPARATIVE EXAMPLES 4 AND 5

Samples were prepared in the same manner as described in Example 1 except that the covering degree (l) was changed by changing only the amount added of maleic anhydride-modified PP of the modified polypropyolene-added epoxy-phenolic paint used for the inner face coating of the vessel proper as shown in Table 2, and the heat seal strength after the retort treatment was measured, and the $KMnO_4$ consumption of the inner face material of the vessel proper having a close relation to the flavor characteristics of the content was measured (according to the method of Notification No. 20 of the Welfare Ministry). The obtained results are shown in Table 2.

If the covering degree l was low as in Comparative Example 4, the heat seal strength was low and the vessel was not suitable as a sealed vessel. If the covering degree l was too high as in Comparative Example 5, the $KMnO_4$ consumption was large and the flavor of the content tended to degrade.

EXAMPLES 11 TO 14

A vessel proper shown in Table 3 was prepared in the same manner as described in Example 1 except that the coating of the inner face was a double-coat layer of the same resin.

A lid shown in Table 4 was prepared in the same manner as described in Example 1. A content shown in Table 4 was filled and then, the retort treatment was carried out under conditions shown in Table 4. In each case, the vessel was not changed by the retort treatment, and the sealing property was perfect. When the heat seal strength after the retort treatment was measured, it was found that the heat seal strength was about 2.5 kg/15 mm as shown in Table 4 and opening by peeling was possible.

When the lid was removed by opening and the content-filled vessel proper was heated for 7 minutes by an oven toaster, generation of an offensive smell was not observed. Moreover, migration of an offensive taste or smell to the heated content was not observed.

EXAMPLE 15

The procedures of Example 1 were repeated in the same manner except that a paint comprising 100 parts by weight of an epoxy-phenolic resin comprising a bisphenol A type epoxy resin and a resol type phenol-formaldehyde resin containing a binuclear component at a weight ratio of 95/5 and 30 parts by weight of an iron oxide type beige pigment was used as the base coat on the inner face of the vessel proper. The same paint as used in Example 1 was used for the topcoat and the evaluation was carried out in the same manner as described in Example 1. It was found that the peeling openability and heat resistance were satisfactory.

EXAMPLE 16

A beige-colored epoxy-phenolic paint was coated in an amount of 65 mg/dm$^2$ on one surface of a soft aluminum sheet having a thickness of 70 $\mu$m.

The other surface of the aluminum sheet was subjected to an acrylic-Zr type surface treatment and a paint formed by dispersing 3 parts by weight (2.9% by weight) of a powder (specific gravity $d_2=0.90$ g/cm$^3$) obtained by adding aluminum hydroxide to modified PP having an average carbonyl group concentration of 150 meq/100 g of the polymer, which was prepared by graft-modifying isotactic homopolypropylene with maleic anhydride, into 100 parts by weight of an epoxy-phenolic paint (specific gravity $d_1=1.20$ g/cm$^3$) comprising a bisphenol A type epoxy resin and a resol type phenol-formaldehyde resin containing a binuclear component at a weight ratio of 80/20 was coated on the treated surface of the aluminum sheet and baked at 230° C. for 40 minutes. The amount coated of the paint was 95 mg/dm$^2$.

When the covering degree l of the obtained modified PP-containing coating was calculated by the formula of $l=L/(1+100\cdot d_2/\times\cdot d_1)$, it was found that the value l was 3.4 ($L=88.3$ $\mu$m, $d_1=1.20$ g/cm$^3$, $d_2=0.90$ g/cm$^3$).

A lid having a size of 85 mm×85 mm and having an opening tab in the corner portion was formed from the obtained coated material by punching.

A blank having a diameter of 135 mm was prepared from a laminate comprising a titanium white-containing PP layer having a thickness of 70 $\mu$m, a steel foil having a thickness of 75 $\mu$m and a titanium white-containing PP having a thickness of 40 $\mu$m, which were bonded by using a urethane adhesive, by punching, and a square vessel having a height of 25 mm, an outer size of 83 mm, an inner size of 70 mm and a corner R of 25 mm and having a flange portion curled outward was formed from this blank according to the draw-forming method using an elastic punch.

The square vessel was filled with seasoned tuna flakes, and the above-mentioned lid was heat-sealed to the vessel. The sealed vessel was subjected to a retort sterilization treatment at 120° C. for 30 minutes. When the heat seal strength between the vessel proper and the lid after the retort sterilization treatment was measured, it was found that the heat seal strength was 2.8 kg/15 mm. The lid was opened from the opening tab, peeling was easily accomplished.

Fifty vessels which had been prepared by filling seasoned tuna flaked and carrying out the retort sterilization in the same manner as described above were divided into two groups, each consisting of 25 vessels, and the two groups of the vessels were subjected to the storage test at 50° C. for 1 month and for 3 months, respectively. The seasoned tuna flake is a highly corrosive content and the storage at 50° C. for 3 months is a very severe condition. However, at this storage test, the results after the opening were very good, and corrosion or peeling was not caused on the inner face of the lid. Similarly, a good state was maintained on the inner face of the vessel proper.

EXAMPLES 17 TO 19 AND COMPARATIVE EXAMPLES 6 TO 8

Samples differing in the covering degree (l) were prepared in the same manner as described in Example 16 except that only the amount added of the maleic anhydride-modified PP of the modified polypropylene-added epoxy-phenolic paint used for coating the inner face of the lid was changed as shown in Table 5, and the samples were subjected to the retort treatment and the heat seal strength was measured. The obtained results are shown in Table 5.

When the modified PP was not added as in Comparative Example 6, heat sealing could not be performed between the lid and the vessel proper, and the lid could not be practically used. Furthermore, when the covering degree (l) was very low as in Comparative Example 7, the heat seal strength between the lid and the vessel proper was very low and the lid was not satisfactory as a lid for a sealed vessel. When the covering degree (l) was too high as in Comparative Example 8, the heat seal strength between the lid and the vessel was too high, and no easy openability was obtained.

EXAMPLES 20 TO 25

Lids were prepared in the same manner as described in Example 16 except that the kind of the thermosetting resin of the modified polypropylene-added thermosetting paint used for coating the inner face of the lid was changed as shown in Table 6. These lids were heat-sealed to vessels shown in Table 6, which had been filled with contents shown in Table 6. The retort sterilization was carried out at 115° C. for 40 minutes in Examples 20 through 23 and at 105° C. for 30 minutes in Examples 24 and 25. With respect to each of the obtained vessels, the heat seal strength was measured. The obtained results are shown in Table 6. In each vessel, a good openability by peeling was attained.

When the storage test was carried out at 50° C. for 3 months, each sample was satisfactory and corrosion or peeling of the inner face was not observed.

EXAMPLE 26

A lid was prepared in the same manner as described in Example 16 except that a paint prepared by dispersing 3 parts by weight (2.9% by weight) of a powder (specific gravity $d_2=0.95$ g/cm$^3$) of maleic anhydride-modified high-density polyethylene having an average carbonyl group concentration of 160 meq/100 g of the polymer instead of the maleic anhydride-modified polypropylene was used.

The covering degree l of the obtained modified HDPE-containing coating was 3.2.

A round injection-molded vessel having a height of 40 mm, an outer diameter of 75 mm and an inner diameter of 65 mm and having a flange was filled with a jelly and the above-mentioned lid (having an outer diameter of 80 mm and having an opening tab) was heat-sealed to the vessel. The filled vessel was subjected to a retort sterilization treatment at 95° C. for 30 minutes. When the heat seal strength between the vessel proper and the lid after the retort sterilization treatment was measured, the heat seal strength was 2.1 kg/15 mm. When the lid was opened from the opening tab, the peeling opening could be easily performed. At the storage test at 50° C. for 3 months, good results were obtained.

TABLE 1

| | Thermosetting Resin | | | | |
|---|---|---|---|---|---|
| | kind | $d_1$ (g/cm$^3$) | softening temperature (°C.) | Amount Added (% by weight) of Modified PP | Covering Degree l |
| Example 2 | epoxy-phenol type: bisphenol A type epoxy resin/binuclear resol type phenol-formaldehyde resin = 90/10 weight ratio | 1.20 | 105 | 5.66 | 58 6.6 |
| Example 3 | epoxy-phenol type: bisphenol A type epoxy resin/p-cresol-bisphenol A-formaldehyde resin = 90/10 weight ratio | 1.20 | 104 | 5.66 | 6.6 |
| Example 4 | epoxy-phenol type: bisphenol A type epoxy resin/binuclear resol type phenol-formaldehyde resin = 70/30 weight ratio | 1.20 | 121 | 5.66 | 6.6 |
| Example 5 | epoxy-amino type: epoxy resin/amino resin = 90/10 weight ratio | 1.18 | 103 | 5.66 | 6.6 |
| Example 6 | epoxy-urea type: epoxy resin/urea resin = 90/10 weight ratio | 1.19 | 102 | 5.66 | 6.6 |
| Example 7 | epoxy-acrylic type: epoxy resin/acrylic resin = 90/10 weight ratio | 1.17 | 98 | 5.66 | 6.6 |
| Comparative Example 1 | epoxy-acrylic type: epoxy resin/acrylic resin = 20/80 weight ratio | 1.17 | 86 | 5.66 | 6.6 |
| Comparative Example 2 | polyester type | 1.25 | 60 | 5.66 | 6.6 |
| Comparative Example 3 | vinyl chloride type | 1.35 | 70 | 5.66 | 6.6 |

| | Generation of bad small at heating in oven toaster | Strange Taste or small of Macaroni gratin | $KMnO_4$ Consumption |
|---|---|---|---|
| Example 2 | not observed | not observed | proper |
| Example 3 | not observed | not observed | proper |
| Example 4 | not observed | not observed | proper |
| Example 5 | not observed | not observed | proper |
| Example 6 | not observed | not observed | proper |
| Example 7 | not observed | not observed | proper |
| Comparative Example 1 | observed | observed | improper |
| Comparative Example 2 | observed | observed | proper |
| Comparative Example 3 | observed | observed | improper |

TABLE 2

| | Amount Added (% by weight) of Modified PP | Covering Degree l | Heat Seal Strength (kg/15 mm) | $KMnO_4$ Consumption |
|---|---|---|---|---|
| Comp. Example 4 | 0.2 | 0.15 | 0.3 | proper |
| Example 8 | 1.0 | 0.76 | 1.8 | proper |
| Example 9 | 2.9 | 2.16 | 2.5 | proper |
| Example 10 | 9.1 | 6.28 | 2.5 | proper |
| Comp. Example 5 | 45 | 21.72 | 2.6 | improper |

Comp.: Comparative

TABLE 3

| | Vessel Proper | | | |
|---|---|---|---|---|
| | outer face paint | metal foil | inner face paint resin | amount coated (mg/dm$^2$) |
| Example 11 | epoxy-phenol type paint (brown) (amount coated = 60 mg/dm$^2$) | 130 μm soft aluminum foil | epoxy benzoguanamine type paint + maleic anhydride-modified PP (average carbonyl group concentration = 150 meq/100 g of polmyer), 5.7% by weight, aluminum hydroxide incorporated | 75/75 double coating |
| Example 12 | epoxy-amino type paint (yellow) (amount coated = 61 mg/dm$^2$) | 130 μm soft aluminum foil | acrylic-Zr type surface-treated epoxy-phenol type paint + maleic anhydride-modified PP (average carbonyl group concentration = 180 meq/100 g of polymer), 7.4% by weight | 75/75 double coating |
| Example 13 | epoxy-phenol type paint (beige) (amount coated = 70 mg/dm$^2$) | 75 μm steel foil (chromated) | epoxy-phenol type paint + maleic anhydride-modified PP (average carbonyl group concentration = 150 meq/100 g of polymer), 13.0% by weight, titanium white, 30% by weight | 75/75 double coating |
| Example | epoxy-phenol type paint | 75 μm steel | epoxy-phenol type paint + maleic anhydride- | 75 single |

TABLE 3-continued

| | | | | | |
|---|---|---|---|---|---|
| 14 | (yellow) (amount coated = 63 mg/dm$^2$) | foil (chromated) | modified HDPE (average carbonyl group concentration = 170 meq/100 g of polymer), 9.1% by weight, aluminum hydroxide incorporated | | coating |
| | | | covering degree l | forming process | shape of vessel |
| | | Example 11 | 4.7 | draw-forming by elastic punch | height: 25 mm<br>outer diameter: 83 mm<br>inner diameter: 70 mm<br>corner R: 25 mm<br>outer curl: square |
| | | Example 12 | 6.2 | draw-forming by metal punch | height: 20 mm<br>outer diameter: 98 × 153 mm<br>inner diameter: 85 × 140 mm<br>corner R: 25 mm<br>outer curl: rectangular |
| | | Example 13 | 10.9 | draw-forming by elastic punch | height: 25 mm<br>outer diameter: 98 × 153 mm<br>inner diameter: 85 × 140 mm<br>corner R: 25 mm<br>outer curl: rectangular |
| | | Example 14 | 7.5 | draw-forming by metal punch | height: 25 mm<br>outer diameter: 83 mm<br>inner diameter: 70 mm<br>corner R: 25 mm<br>outer curl: square |

Note
In case of double coating, the covering degree (l) of modified PP was the value calculated with respect to the second coat.

TABLE 4

| | Lid | | | Retorting | Heat Seal Strength (kg/15 mm |
|---|---|---|---|---|---|
| | substrate | adhesive | sealing material | Conditions | of width) |
| Example 11 | 12 μm PET/15 μm biaxially drawn nylon/20 μm aluminum foil | 10 μm ethylene-propylene copolymer/5 μm maleic anhydride-modified PP | 30 μm ethylene-propylene copolymer support layer/ 5 μm blend (70% by weight of PP and 30% by weight of LDPE) | 120° C. 30 minutes (content: scallop coquille) | 2.5 |
| Example 12 | 12 μm PET/15 μm biaxially drawn nylon/20 μm aluminum foil | 10 μm ethylene-propylene copolymer/5 μm maleic anhydride-modified PP | 30 μm ethylene-propylene copolymer support layer/ 5 μm blend (70% by weight of PP and 30% by weight of LDPE) | 120° C. 30 minutes (content: shrimp doria) | 2.6 |
| Example 13 | 12 μm PET/15 μm biaxially drawn nylon/20 μm aluminum foil | 10 μm ethylene-propylene copolymer/5 μm maleic anhydride PP | 30 μm ethylene-propylene copolymer support layer/ 5 μm blend (70% by weight of PP and 30% by weight of LDPE) | 120° C. 30 minutes (content: Lasagna) | 2.5 |
| Example 14 | 12 μm PET/15 μm biaxially drawn nylon/20 μm aluminum foil | 10 μm blend (70% by weight of HDPE and 30% by weight of LDPE)/5 μm maleic anhydride-modified HDPE | 30 μm HDPE support layer/ 5 μm blend (70% by weight of HDPE and 30% by weight of talc) | 105° C. 30 minutes (content: Raviori) | 2.4 |

TABLE 5

| | Amount Added (% by weight) of Modified PP | Covering Degree (l) | Heat Seal Strength (kg/15 mm) |
|---|---|---|---|
| Comp. Example 6 | 0 | 0 | 0 |
| Comp. Example 7 | 0.2 | 0.21 | 0.3 |
| Example 17 | 1.0 | 1.04 | 1.8 |

TABLE 5-continued

| | Amount Added (% by weight) of Modified PP | Covering Degree (l) | Heat Seal Strength (kg/15 mm) |
|---|---|---|---|
| Example 18 | 2.0 | 2.07 | 2.4 |
| Example 19 | 5.0 | 5.03 | 3.2 |
| Comp. Example 8 | 35 | 25.21 | 6.5 |

Comp.: Comparative

TABLE 6

| | Lid | | | |
|---|---|---|---|---|
| | Kind of inner face paint | $d_1$ (g/cm$^3$) | Amount coated (mg/dm$^2$) | Covering degree (l) |
| Example 20 | epoxy-phenol type: bisphenol A type epoxy resin/binuclear resol type phenol-formaldehyde resin = 90/10 weight ratio | 1.20 | 95 | 3.4 |
| Example | epoxy-phenol type: bisphenol A | 1.20 | 95 | 3.4 |

TABLE 6-continued

| | | | | |
|---|---|---|---|---|
| 21 | type epoxy resin/p-cresol-bisphenol A-formaldehyde resin = 90/10 weight ratio | | | |
| Example 22 | epoxy-phenol type: bisphenol A type epoxy resin/binuclear resol type phenol-formaldehyde resin = 70/30 weight ratio | 1.20 | 95 | 3.4 |
| Example 23 | epoxy-amino type: epoxy resin/amino resin = 90/10 weight ratio | 1.18 | 95 | 3.4 |
| Example 24 | epoxy-urea type: epoxy resin/urea resin = 90/10 weight ratio | 1.19 | 95 | 3.4 |
| Example 25 | epoxy-acrylic type: epoxy resin/acrylic resin = 90/10 weight ratio | 1.17 | 95 | 3.4 |

| | Vessel Proper | | | | Heat Seal |
|---|---|---|---|---|---|
| | material | forming method | shape of vessel | Content | Strength (g/15 mm) |
| Example 20 | epoxy-amino type paint (outer face)/130 μm aluminum foil/70 μm PP (inner face) | draw-forming by metal punch | height: 20 mm<br>outer diameter: 98 × 153 mm<br>inner diameter: 85 × 140 mm<br>corner R: 25 mm<br>outer curl: rectangular | potato salad | 2.6 |
| Example 21 | 150 μm PP/20 μm EVOH/150 μm PP | heat forming from sheet | height: 30 mm<br>outer diameter: 25 mm<br>inner diameter: 105 mm<br>round | chinese glutinous rice | 2.7 |
| Example 22 | epoxy-phenol type paint (outer face)/75 μm steel foil/70 μm PP (inner face) | draw-forming by elastic punch | height: 25 mm<br>outer diameter: 83 mm<br>inner diameter: 70 mm<br>corner R: 25 mm<br>outer curl: square | grilled chicken | 2.5 |
| Example 23 | epoxy-phenol type paint (outer face)/75 μm steel foil/70 μm PP (inner face) | draw-forming by elastic punch | height: 25 mm<br>outer diameter: 83 mm<br>inner diameter: 70 mm<br>corner R: 25 mm<br>outer curl: square | broilled cod roe | 2.4 |
| Example 24 | epoxy-phenol type paint (outer face)/75 μm steel foil/70 μm PP (inner face) | draw-forming by elastic punch | height: 25 mm<br>outer diameter: 83 mm<br>inner diameter: 70 mm<br>corner R: 25 mm<br>outer curl: square | wine jelly | 2.3 |
| Example 25 | PP | injection molding | height: 40 mm<br>outer diameter: 75 mm<br>inner diameter: 65 mm<br>round | fruit jelly | 2.1 |

What is claimed is:

1. An easy-open sealed packaging vessel comprising
a flanged vessel proper,
a lid, and
a heat-sealed portion formed between the flange of the vessel proper and the lid, wherein one of the flanged vessel proper and the lid has a covered structure comprising
(i) a metal foil sheet, and
(ii) a coating on the inner surface of the metal sheet, said coating having a composition comprising
(a) a thermosetting resin, and
(b) 0.8 to 30% by weight, based on the coating, of an acid-modified olefin resin dispersed in the thermosetting resin, said coating having a covering degree (l) in the range of from 0.3 to 20, said covering degree (l) being defined by the following formula:

$$l = \frac{L}{1 + \frac{100}{X} \cdot \frac{d_2}{d_1}}$$

wherein
L represents the thickness in μm of the coating,
X represents the amount incorporated of the acid-modified polyolefin in parts by height per 100 parts by weight of the thermosetting resin,
$d_1$ represents the density in g/cm$^3$ of the thermosetting resin, and
$d_2$ represents the density in g/cm$^3$ of the acid-modified polyolefin, and the other of the flanged vessel proper and the lid has a structure with a polyolefin resin at least on the inner face side thereof, whereby an easily peelable sealing is attained between the lid and the flange of the vessel proper.

2. A vessel as set forth in claim 1, wherein the coating of said thermosetting resin having said acid-modified olefin resin dispersed therein is a coating of an epoxy-curing agent resin containing 0.8 to 30% by weight, based on the coating, of an acid-modified olefin resin.

3. A vessel as set forth in claim 1, wherein the polyolefin resin of at least the inner face side is an olefin copolymer or an olefin resin blend comprising 50 to 95% by weight of units of the same olefin as the olefin of the acid-modified olefin resin.

4. A vessel as set forth in claim 1, wherein the acid-modified olefin resin is an acid-modified polypropylene resin and the inner face material is a polymer blend comprising
(i) polypropylene or a propylene/ethylene copolymer and (ii) polyethylene and having a propylene unit content of 50 to 95% by weight.

5. A vessel as set forth in claim 1, wherein the flanged vessel proper is a vessel obtained by draw-forming of a metal foil sheet coated with a composition formed by, dispersing in a thermosetting resin, an acid-modified olefin resin in such an amount as giving an easily peelable bonding and the lid comprises a metal foil laminate having a polyolefin resin as the inner face material.

6. A vessel as set forth in claim 5, wherein the coating of said thermosetting resin having said acid-modified olefin resin dispersed therein of the coated metal foil sheet is a coating of an epoxy-curing agent resin containing 0.8 to 50% by weight, based on the coating, of an acid-modified olefin resin and the inner face material of the metal foil laminate is an olefin copolymer or an olefin resin blend comprising 50 to 95% by weight of units of the same olefin as the olefin of the acid-modified olefin resin.

7. A vessel as set forth in claim 6, wherein the inner face material comprises a polypropylene film having a thickness of 15 to 100 μm, having on the surface thereof a layer of said blend having a thickness of 2 to 10 μm.

8. A vessel as set forth in claim 1, wherein the flanged vessel proper is a vessel, at the least inner face side of which comprises a polyolefin resin, and the lid comprises a coated metal foil sheet having a coating of said composition formed by, dispersing in a thermosetting resin, an acid-modified olefin resin on the inner face side.

9. A vessel as set forth in claim 8, wherein the flanged vessel proper is a plastic vessel of a polyolefin or a laminate of a polyolefin and another thermoplastic resin.

10. A vessel as set forth in claim 9, wherein the flanged vessel proper is a vessel obtained by draw-forming of a metal foil laminate having a polyolefin inner face layer.

11. A toastable packaging vessel comprising a flanged vessel proper prepared by draw-forming of a metal foil sheet and a lid heat-sealed to the flange of the vessel proper, wherein the vessel proper has on the entire inner face including the flange an inner face-protecting coating having of a composition comprising (a) a thermosetting resin having a heat softening temperature of 90 to 130° C., and (b) 0.8 to 30% by weight, based on the coating, of an acid-modified olefin resin dispersed in the thermosetting resin, said coating having a covering degree (l) in the range of from 0.03 to 20, said covering degree (l) being defined by the following formula:

$$l = \frac{L}{1 + \frac{100}{X} \cdot \frac{d_2}{d_1}}$$

wherein

L represents the thickness in μm of the coating,

X represents the amount incorporated of the acid-modified polyolefin in parts by weight per 100 parts by weight of the thermosetting resin, $d_1$ represents the density in g/cm$^3$ of the thermosetting resin, and $d_2$ represents the density in g/cm$^3$ of the acid-modified polyolefin.

* * * * *